United States Patent [19]

Freissmuth et al.

[11] 4,315,773

[45] Feb. 16, 1982

[54] DESULFURIZATION MIXTURE AND PROCESS FOR DESULFURIZING PIG IRON

[75] Inventors: Alfred Freissmuth, Trostberg; Werner Gmohling, Hufschlag; Heinrich Rock, Trostberg, all of Fed. Rep. of Germany

[73] Assignee: SKW Trostberg Aktiengesellschaft, Trostberg, Fed. Rep. of Germany

[21] Appl. No.: 97,858

[22] Filed: Nov. 27, 1979

[51] Int. Cl.[3] ..... C21C 7/02

[52] U.S. Cl. ..... 75/58; 75/52; 75/53

[58] Field of Search ..... 75/52, 53, 58

[56] References Cited

U.S. PATENT DOCUMENTS

| | | | |
|---|---|---|---|
| 3,716,352 | 2/1973 | Ooi | 75/58 |
| 3,876,421 | 4/1975 | Takemura | 75/53 |
| 3,929,464 | 12/1975 | Todd | 75/58 |
| 4,078,915 | 3/1978 | Meichsner | 75/58 |
| 4,169,724 | 10/1979 | Freissmuth | 75/53 |

*Primary Examiner*—P. D. Rosenberg

*Attorney, Agent, or Firm*—Curtis, Morris & Safford

[57] ABSTRACT

Process and composition for desulfurizing pig iron in which the desulfurization agent consists essentially of calcium carbide, a gas-evolving component and fluorspar; the advantage of the process and composition is that it reduces dust pollution and danger of flaming in the handling of the slag after the desulfurization of pig iron.

10 Claims, No Drawings

DESULFURIZATION MIXTURE AND PROCESS FOR DESULFURIZING PIG IRON

The invention relates to an improvement in the process of desulfurizing pig iron which comprises carrying out the desulfurization with a desulfurization mixture of calcium carbide, a gas-evolving component and from about 2 to 10% by weight, based on the weight of the mixture, of fluorspar. The improvement achieved is manifested by an abatement of the dust and flame nuisance encountered in the handling of slags removed from molten pig iron after desulfurization.

In modern steel technology, desulfurization of the molten metal is normally accomplished outside the blast-furnace either in a transport ladle, a so-called submarine ladle, or in an open ladle which is used, for example, for transporting the pig iron from a submarine ladle to a mixer or directly to a converter or for transporting it from a mixer to a converter.

Adequate desulfurization results are obtained with soda, with a mixture of soda and finely ground lime, with lime and one or more fluxes, and with mixtures based on other alkali metal and alkaline earth metal compounds. However, these desulfurizing agents and mixtures have the disadvantage of resulting in the emission of considerable quantities of alkali metal oxides, which pollute the environment.

A further development of desulfurization technology was achieved by the use of calcium carbide, which is conveyed pneumatically into the molten iron. In particular, mixtures of calcium carbide with gas-evolving additives lead to a reduction in the quantities required and, compared with the use of alkali metal compounds, assist in substantially reducing the emission of dust.

After the desulfurization treatment, a slag formed from the reaction product of the desulfurizing agent with the sulfur dissolved in the iron covers the surface of the pig iron in the ladle. Before the desulfurized pig iron is filled into the steel-producing unit, this slag must be skimmed or raked off since it contains the sulfur, removed from the iron by the treatment, in a bound form. Skimming slag from open ladles is effected manually, using tools suitable for this purpose, or using a mechanical device. Frequently, the slag is accumulated at a point particularly suitable for raking off by the flushing action of rising gas bubbles.

When desulfurization mixtures are used which contain calcium carbide, the resulting slag contains free carbon which is formed according to the following equation:

$$CaC_2 + S \rightarrow CaS + 2C$$

Moreover, in the treatment of pig iron saturated with carbon, the slag can contain additional carbon in the form of kish. This separates out on cooling of the pig iron, during the time of the desulfurization treatment, due to the reduction of the solvent capacity of the iron for carbon.

Finally, the desulfurization slag can also contain carbon originating from carbon-containing additives or components of the desulfurizing reagent (for example graphite, coal, coke or diamide lime).

Since the desulfurization slag has a solid, crumbly and partially dusty consistency when desulfurizing agents containing calcium carbide are used, the carbon contained in the slag escapes during the deslagging process with the rising hot air and forms black dust clouds which pollute the environment.

Due to the high temperature and the fine division of the carbon, the carbon dust can ignite and burn with flames several meters long. This is particularly troublesome and undesirable when deslagging in the steelworks bay because expensive equipment is required to extract and clean such large quantities of dust laden air. Tapped slags cannot remain in the bay, but are dumped on a heap. On picking-up these still incandescent products and, especially when they are exposed to fresh air on dumping, these carbon-containing dusty waste products form large clouds of smoke and often re-ignite to form high flames.

This troublesome evolution of dust and flames is particularly pronounced if the surface of the molten metal was completely freed from blast-furnace slag before the desulfurization treatment, such removal being a prerequisite for an effective desulfurization treatment.

It is therefore a primary object of this invention to provide a process for abating the dust and flame nuisance in the handling of slags after desulfurization of pig iron and to provide a composition containing calcium carbide which is suitable for this purpose and, in addition, has a good desulfurization capability, can be integrated without difficulty into the conventional desulfurization process and will make a substantial contribution to a reduction in the dust and flame nuisance during the desulfurization of pig iron.

In accordance with the invention, this object is achieved by adding fluorspar to desulfurization mixtures based on calcium carbide and gas-evolving components.

To the best of our knowledge, desulfurization mixtures, based on calcium carbide and gas-evolving components, and additionally containing fluorspar, were hitherto unknown. It has been suggested to add fluorspar to mixtures based on lime or limestone, and to mixtures containing alkali and silica, in order to improve the activity of the lime or of the alkali as a desulfurization agent. It was not, however, possible to deduce from this action of fluorspar in lime and silica-containing compositions that the dusting and burning of carbon-containing desulfurization slag produced from calcium carbide-containing compositions would be reduced or prevented by a relatively small addition of fluorspar to such desulfurization compositions without at the same time adversely affecting the desired simple handling of the crumbly, readily flowable slag in any way.

The compositions proposed for the process according to the invention not only help to make the handling of the slags obtained in the desulfurization of pig iron, and hence the entire process itself, more economical, but also have the advantage of greatly reducing or preventing the evolution of smoke and flames, and thereby pollution of the environment, from the slags produced by the desulfurization mixtures hitherto known.

To achieve the stated results, the addition of about 2 to 10% by weight (pbw) fluorspar, relative to the total weight of the desulfurization mixture, is sufficient. Preferably, about 3 to 8 pbw of technical grade fluorspar are used.

The added fluorspar develops its activity in all desulfurization mixtures which contain carbon in any form or in which carbon is produced in the course of the desulfurization reaction, such as, for example, in the case of desulfurization mixtures containing calcium carbide.

These mixtures of the invention consist essentially of calcium carbide, one or more gas-evolving compounds and fluorspar. If appropriate, they may also contain additional carbon, metals having a reducing action and metal carbides.

Compositions containing 30 to 90 pbw of calcium carbide, 2 to 70 pbw of gas-evolving component, 2 to 10 pbw of carbon and 2 to 10 pbw of fluorspar are of particular interest. The calcium carbide used is a technical grade containing about 80 pbw of calcium carbide.

Suitable gas-evolving components are, for example, compounds which develop water, such as hydrated limes, water-containing borates, aluminum hydroxides, perlites, clays, carbohydrates and solid organic monomeric or polymeric oxygen compounds which produce water vapor when they are thermally decomposed, such as polyesters, polyvinyl alcohol, phthalic acid and glycollic acid. Compounds evolving hydrogen, such as hydrides of alkali metals and alkaline earth metals, hydrogen-containing organic polymers, for example polyolefines, polyamides, polystyrene, polyacrylonitrile and other suitable, even monomeric compounds, can also be employed.

Diamide lime, that is to say a mixture of finely divided calcium carbonate and carbon in the form of graphite, or polyethylene is preferably used as the gas-evolving component in desulfurization mixture containing calcium carbide. However, synthetic mixtures of calcium carbonate in a finely ground or precipitated form and carbon can also be employed.

When diamide lime is used as the gas-evolving component, mixtures of the following composition are preferred: 50 to 85 pbw of calcium carbide, 5 to 40 pbw of diamide lime, 3 to 8 pbw of fluorspar and 2 to 10 pbw of graphite. Agents of this type combine a high desulfurization effect with excellent fluidisability and do not form slags which pollute the environment in any way.

Moreover, the added fluorspar develops its activity as an agent against a dust and flame nuisance in mixtures which, in addition to the other components, also contain metals which have a reducing action, such as aluminum or magnesium, alloys, such as, for example, calcium/silicon, or metal carbides in order to assist the desulfurizing action.

The effectiveness of desulfurization mixtures is not adversely affected by the addition of fluorspar. The addition of fluorspar very substantially improves and simplifies the procedure in the desulfurization of pig iron with desulfurization mixtures containing calcium carbide, particularly in open ladles. Handling of the slag produced is facilitated since the latter now forms hardly any dust and no longer burns. The slag can readily be removed from the surface of the metal bath. Neither are there any problems in transporting the slag away and dumping it.

The advantages of the process of the invention will become more apparent from a comparison of the examples which follow.

EXAMPLE 1

In a steelworks, pig iron freed from blast-furnace slag was regularly desulfurized in open ladles of 210 tons capacity, on the average, by blowing in a finely ground mixture of 85% by weight of technical grade carbide with a content of 78% by weight of $CaC_2$ and 15% by weight of diamide lime, which is a mixture of finely divided calcium carbonate and carbon. The quantity of the carbide/diamide lime mixture added was in each case adapted to the weight of the pig iron and to the initial sulfur content of the latter. The pig iron supplied contained in the mean 0.048% of sulfur. On average, 810 kg of desulfurization mixture were blown in per ladle. Injection was effected with dry air at an injection rate of about 100 kg of solids/minute, about 51 of gas/kg of solids being used. After the treatment, the sulfur content was lowered to an average of 0.015%.

After the desulfurization treatment, the surface of the pig iron was covered with the slag formed from the desulfurizing agent. Air was blown into the pig iron through a bubbling brick fitted on the rear of the ladle. The slag was driven away from the rear of the ladle and forwards to the spout by the rising column of bubbles. At the spout, it was tapped from the slightly inclined ladle, using a deslagging machine in the customary manner. During skimming of the slag from the ladle, large quantities of black dust were whirled up. Large black clouds rose in particular when the skimmed slag dropped down into the boxes provided for receiving the slag. This dust burned again and again with flames meters long. The slag again produced dust when the slag was filled into charging boxes by means of wheeled loaders. Finally, clouds of black smoke, many meters high, were formed when the charging boxes with the hot slag were emptied on the slag heap.

EXAMPLE 2

A finely ground mixture of likewise 85% by weight of technical grade carbide, 6% by weight of graphite carbon, 3% by weight of polyethylene and 6% by weight of fluorspar was prepared in a quantity of several 100 tons and employed for the desulfurization of pig iron. It was found that the consumption data for this desulfurization mixture according to the invention, relative to identical initial and final sulfur contents, were in agreement with those for the carbide/diamide lime mixture, with only a few percent fluctuation. The desulfurization slags obtained with the mixture according to the invention were less voluminous than those obtained with the mixture hitherto used for treating pig iron melts. The slag was crumbly and was very easy to tap. No dust or flame phenomena were observed either during the dropping-down of the slag or during the subsequent transporting and dumping.

We claim:

1. A process which comprises desulfurizing pig iron with a mixture of calcium carbide, a gas-evolving component, and about 2 to 20 pbw, based on the total weight of the mixture, of fluorspar.

2. The process defined in claim 1 wherein the mixture additionally contains carbon, one or more metals having a reducing action, or a metal carbide, or a combination thereof.

3. The process defined in claim 1 wherein the mixture comprises about 30 to 90 pbw calcium carbide, about 2 to 70 pbw gas-evolving component, about 2 to 10 pbw carbon and about 2 to 10 pbw fluorspar.

4. The process defined in claim 1 wherein the mixture comprises about 50 to 85 pbw calcium carbide, about 5 to 40 pbw diamide lime, about 2 to 10 pbw graphite and about 3 to 8 pbw fluorspar.

5. The process defined in claim 1 wherein the mixture comprises about 85 pbw calcium carbide, about 6 pbw fluorspar, about 6 pbw carbon and about 3 pbw polyethylene.

6. A composition for desulfurizing pig iron which comprises a mixture of calcium carbide, a gas-evolving component and about 2 to 20 pbw, based on the total weight of the mixture, of fluorspar.

7. A composition as defined in claim 6 wherein the mixture additionally contains carbon, one or more metals having a reducing action, or a metal carbide, or a combination thereof.

8. The composition defined in claim 6 wherein the mixture comprises about 30 to 90 pbw calcium carbide, about 2 to 70 pbw gas-evolving component, about 2 to 10 pbw carbon and about 2 to 10 pbw fluorspar.

9. The composition defined in claim 6 wherein the mixture comprises about 50 to 85 pbw calcium carbide, about 5 to 40 pbw diamide lime, about 2 to 10 pbw graphite and about 3 to 8 pbw fluorspar.

10. The composition defined in claim 6 wherein the mixture comprises about 85 pbw calcium carbide, about 6 pbw fluorspar, about 6 pbw carbon and about 3 pbw polyethylene.

* * * * *